US006908004B2

(12) United States Patent
Barr

(10) Patent No.: US 6,908,004 B2
(45) Date of Patent: Jun. 21, 2005

(54) COLLAPSIBLE STORAGE BIN

(75) Inventor: David Alan Barr, Arlington, TX (US)

(73) Assignee: KidKraft, LP, Dallas, TX (US)

( * ) Notice: Subject to any disclaimer, the term of this patent is extended or adjusted under 35 U.S.C. 154(b) by 0 days.

(21) Appl. No.: 10/396,205

(22) Filed: Mar. 25, 2003

(65) Prior Publication Data

US 2003/0183628 A1 Oct. 2, 2003

Related U.S. Application Data

(60) Provisional application No. 60/368,097, filed on Mar. 26, 2002.

(51) Int. Cl.[7] ..... B65D 6/24

(52) U.S. Cl. ..... 220/4.26; 220/4.03; 220/691

(58) Field of Search ..... 220/4.26, 4.03, 220/691, 621, 618, 677, 617, 8

(56) References Cited

U.S. PATENT DOCUMENTS 848,698 A * 4/1907 Smith ..... 220/4.03
1,482,425 A * 2/1924 Ziony ..... 220/8
2,438,434 A * 3/1948 Friedman ..... 220/8
2,834,502 A * 5/1958 Trojan ..... 220/8
3,990,179 A 11/1976 Johnson et al.
5,474,195 A 12/1995 Pai
5,544,751 A 8/1996 Klodt et al.
5,662,026 A * 9/1997 Prakasa ..... 99/413
5,715,962 A 2/1998 McDonnell
5,979,691 A * 11/1999 Von Holdt ..... 220/266

* cited by examiner

*Primary Examiner*—Stephen Castellano

(57) ABSTRACT

A collapsible storage bin having a base member and an upper containment member is provided. The base member includes a plurality of base walls, and a downwardly facing lip is disposed on at least one of the base walls. The upper containment member includes a plurality of containment walls, and an upwardly facing lip is disposed on at least one of the containment walls. The upwardly facing lip is configured to matingly engage the downwardly facing lip when the base member and the upper containment member are in an assembled position. A locking tab on the containment member is configured to lockingly engage a recess on the base member to lock the base member and the upper containment together in the assembled position.

10 Claims, 4 Drawing Sheets

COLLAPSIBLE STORAGE BIN

CROSS-REFERENCE TO RELATED APPLICATIONS

This application claims the benefit of U.S. Provisional Application No. 60/368,097, filed Mar. 26, 2002, which is hereby incorporated by reference.

BACKGROUND OF THE INVENTION

1. Field of the Invention

This invention relates generally to storage systems, and more particularly to a modular and collapsible storage bin that is capable of being assembled for storing items or disassembled for packing and shipping of the storage bin.

2. Description of Related Art

Storage containers are made in many shapes and sizes to store an incredible number of different items. Some storage containers are used to store food, while others protect dry goods and textiles. Still other containers may store collectibles. No matter what the item, storage containers are typically used to provide organization and protection.

A critical problem encountered by some storage containers is related to what is typically also considered a desirable container trait: volume. It is often desirable to have a storage container of great volume so that a large number of items, or simply large items, can be housed within the container. The drawback, however, is imposed by shipping, packaging, and storage requirements for the storage container. When manufacturers package and ship storage containers, it is much less expensive if the storage container can be housed in a small box. A large portion of the volume inside a package housing a storage container is empty space. When the size of the package is minimized, less packaging material is required, and the volume occupied by the package on a shipping vehicle is less. This dramatically reduces the costs involved in shipping and packaging, especially when a large number of individual packages are being shipped.

It is also desirable to minimize the occupied volume of a container when storing the container itself. Storage containers are not always in use, so it is beneficial if the container can be easily and efficiently stored. Since it is one goal of storage containers to reduce clutter, it becomes counterproductive if the storage container itself cannot be efficiently stored when not in use.

Although collapsible storage containers currently exist, the structural integrity of the containers, especially in the area that connects the various portions of the container, is typically lacking. Often these containers are flimsy to the point of being unable to properly store the number or size of items that were intended to be stored. Typically, the collapsible containers that do provide the necessary support for storing items are very difficult to assemble and disassemble, effectively defeating the purpose of having a collapsible storage container.

A need exists, therefore, for a collapsible storage container that occupies a relatively small amount of space when collapsed, yet provides exceptional strength and rigidity when assembled. A need further exists for a storage container that can be easily collapsed and nested prior to packaging and shipping container. A nested container occupies less volume, thus reducing the costs of packaging and shipping. A storage container is also needed that is easily collapsed by a user for storage during periods of non-use. Finally, a collapsible storage container is needed that is easily and inexpensively manufactured.

BRIEF SUMMARY OF THE INVENTION

The problems presented by existing storage containers are solved by the present invention. A collapsible storage bin having a base member and an upper containment member is provided. The base member includes a plurality of base walls joined at a first end by a floor. A first lip member is formed on a second end of the base walls. The upper containment member includes a plurality of containment walls, and a second lip member is formed on one end of the containment walls. The first lip member is configured to mate with the second lip member when the base member and the containment member are placed in an assembled position. A tab on either the base member or the containment member is configured to lockingly engage a recess on the other of the base member and the containment member. The tab and recess lock the base member and the containment member in the assembled position so that the first lip member and the second lip member do not become disengaged.

The storage bin is capable of disassembly by disengaging the tab and the recess and disengaging the first lip member and the second lip member. The base walls and the containment walls are tapered, and the base member is configured to nest within the containment walls of the containment member when the storage bin is placed in a disassembled, or nested position. In the nested position, the storage bin occupies a much smaller volume of space than when the storage bin is in the assembled position. The smaller volume significantly reduces packaging and shipping costs for the storage bin.

Other objects, features, and advantages of the present invention will become apparent with reference to the drawings and detailed description that follow.

DETAILED DESCRIPTION OF THE PREFERRED EMBODIMENT

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical, structural, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
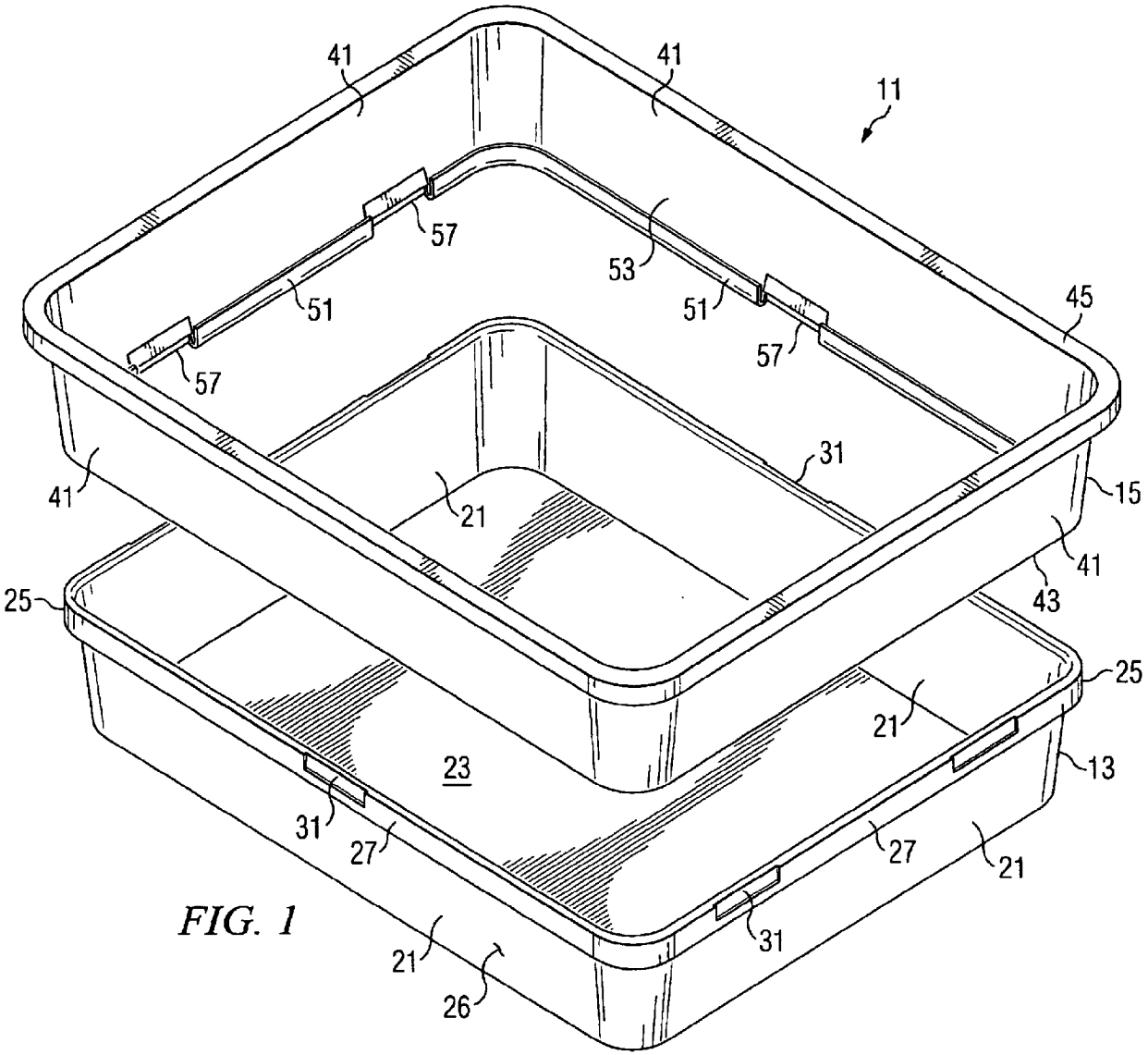
FIG. 1 illustrates an exploded perspective view of a collapsible storage bin having a base member and an upper containment member according to the present invention.
Figure 2:
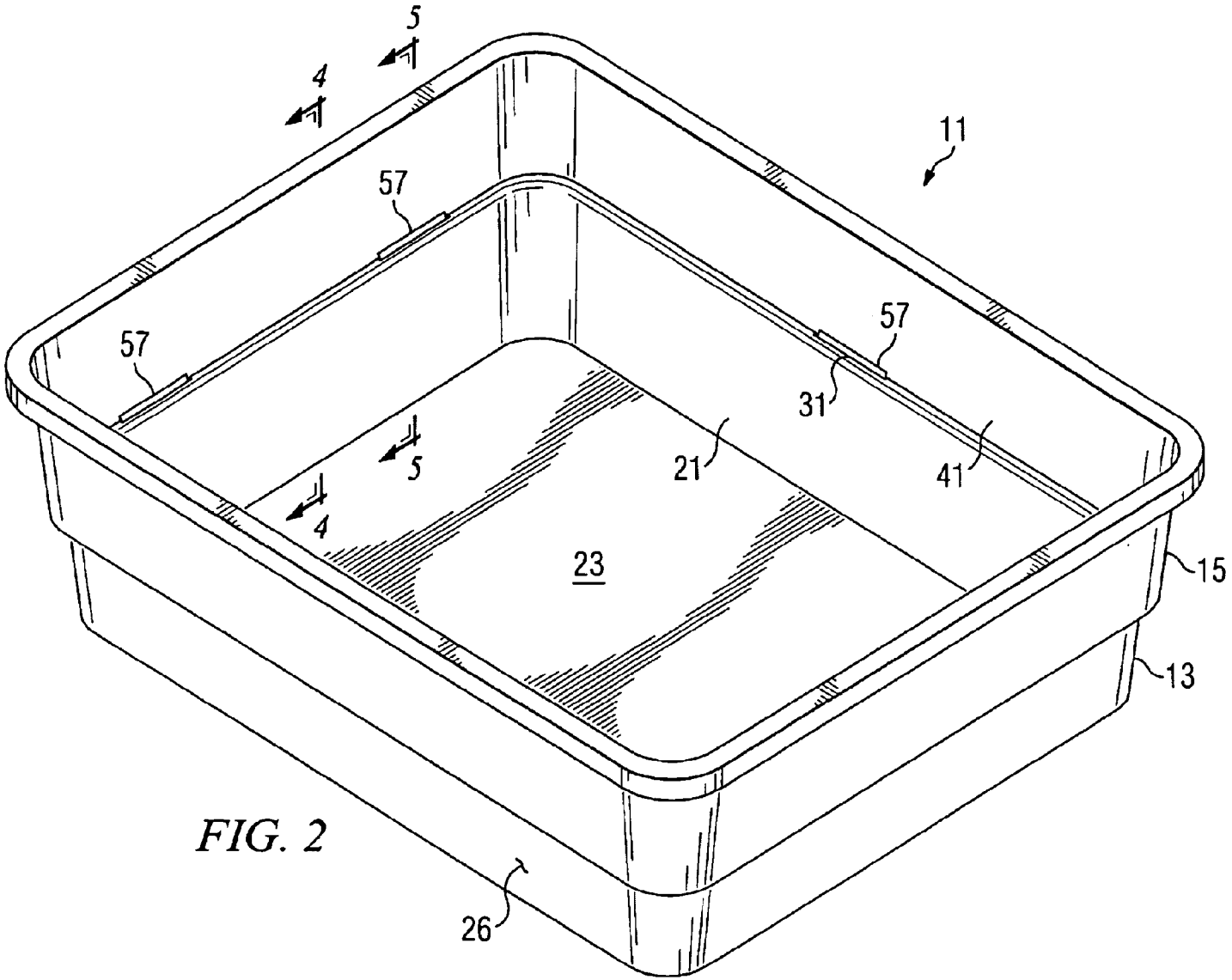
FIG. 2 depicts a perspective view of the base member and the upper containment member of FIG. 1 in an assembled position, the upper containment having an upwardly facing lip and a locking tab that engage a downwardly facing lip and a recess on the base member.
Figure 3:
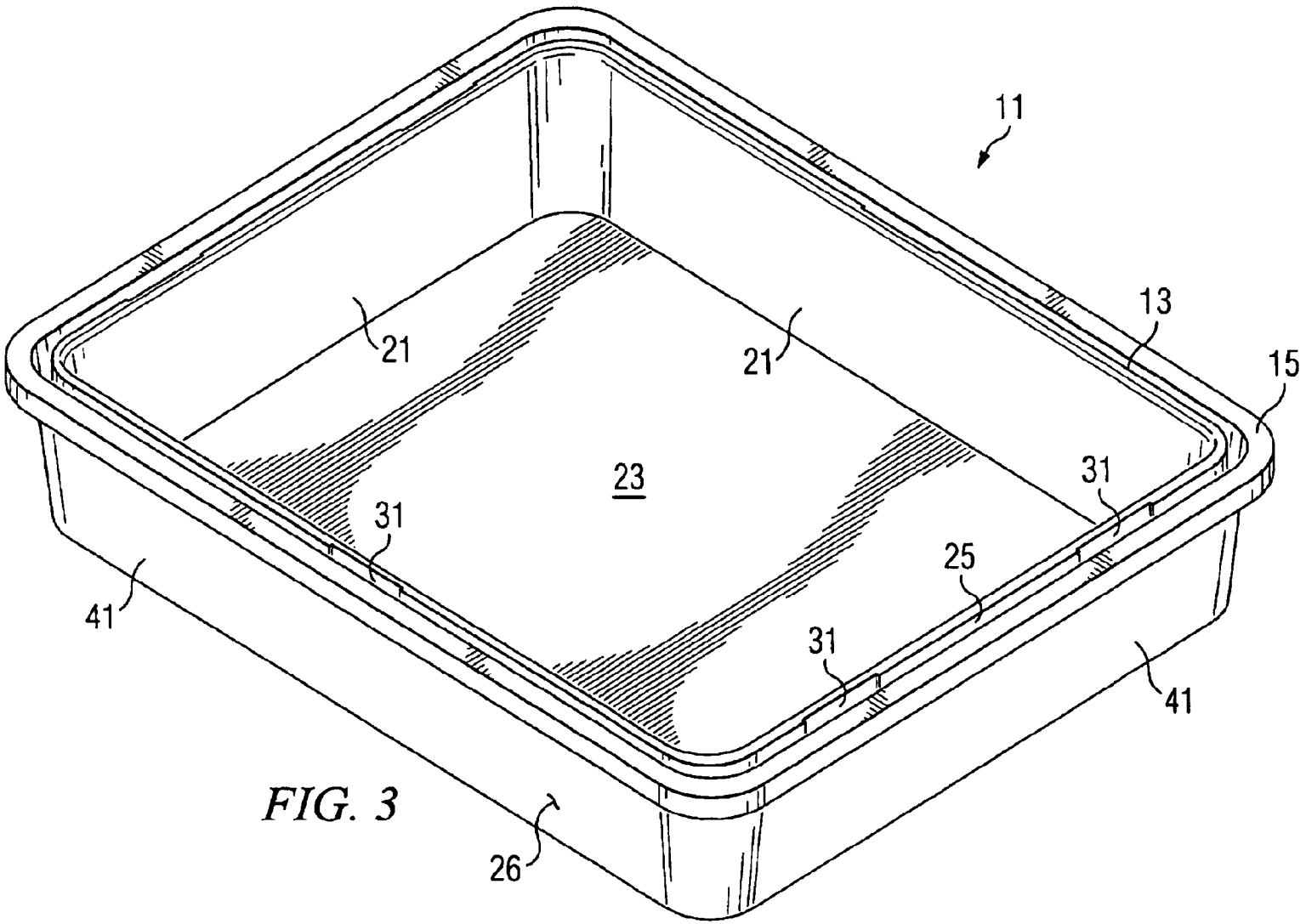
FIG. 3 illustrates a perspective view of the base member and the upper containment member of FIG. 1 in a nested position.

Referring to FIGS. 1, 2, and 3 in the drawings, a collapsible storage bin 11 having a base member 13 and an upper containment member 15 is illustrated. Base member 13 includes a plurality of base walls 21 integrally joined at a closed end to a floor 23. An open end of each base wall terminates in a downwardly facing lip 25, or first lip member protruding outward from an exterior surface 26 of base wall 21. Each downwardly facing lip includes an outer surface 27. Preferably, four base walls 21 form the base member 13, and the downwardly facing lip 25 extends around the entire perimeter of the base member 13 at the open end of the base walls 21. A recess 31 is disposed at various locations on the outer surface 27 of the downwardly facing lip member 25.

Upper containment member 15 includes a plurality of containment walls 41 having an engagement end 43 and a non-engagement end 45. In a preferred embodiment, four containment walls 41 are provided. The engagement end 43 includes an upwardly facing lip 51, or second lip member extending inward from an inner surface 53 of containment wall 41. The upwardly facing lip 51 preferably extends around the perimeter of the engagement end 43, with the exception of several areas on the engagement end 43 that include locking tabs 57.

Figure 4:
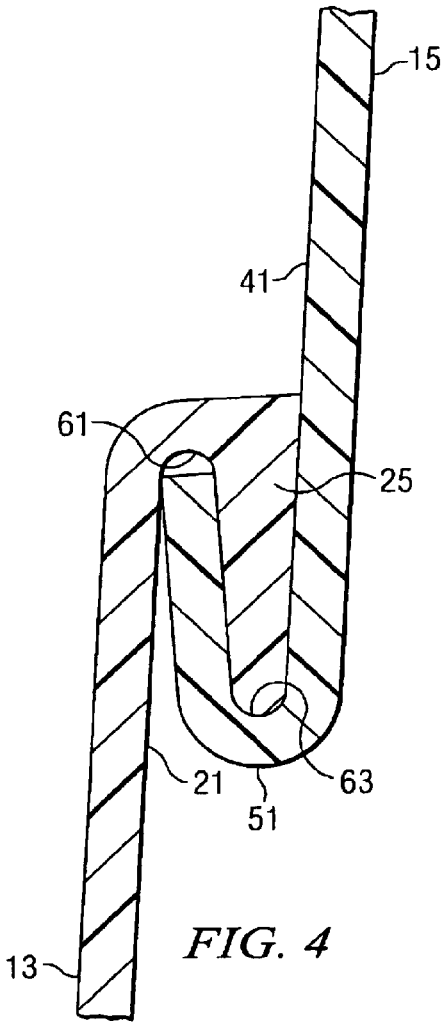
FIG. 4 depicts a cross-sectional side view of the downwardly facing lip and the upwardly facing lip of FIG. 2 taken at IV—IV.

Downwardly facing lip 25, upwardly facing lip 51, recesses 31, and locking tabs 57 are configured to lock the base member 13 and the containment member 15 in an assembled position as shown in FIG. 2. Referring to FIG. 4 in the drawings, downwardly facing lip 25 has a generally hook-shaped cross section that forms a first receiving groove 61 between downwardly facing lip 25 and base wall 21. Upwardly facing lip 51 has a generally hook-shaped cross section that forms a second receiving groove 63 between upwardly facing lip 51 and containment wall 41. In the assembled position, upwardly facing lip 51 is configured to engage downwardly facing lip 25 such that first receiving groove 61 receives upwardly facing lip 51, and second receiving groove 63 receives downwardly facing lip 25. The engagement of upwardly facing lip 51 and downwardly facing lip 25 prevent movement of containment member 15 relative to base member 13 in every direction except the downward direction.

Figure 5:
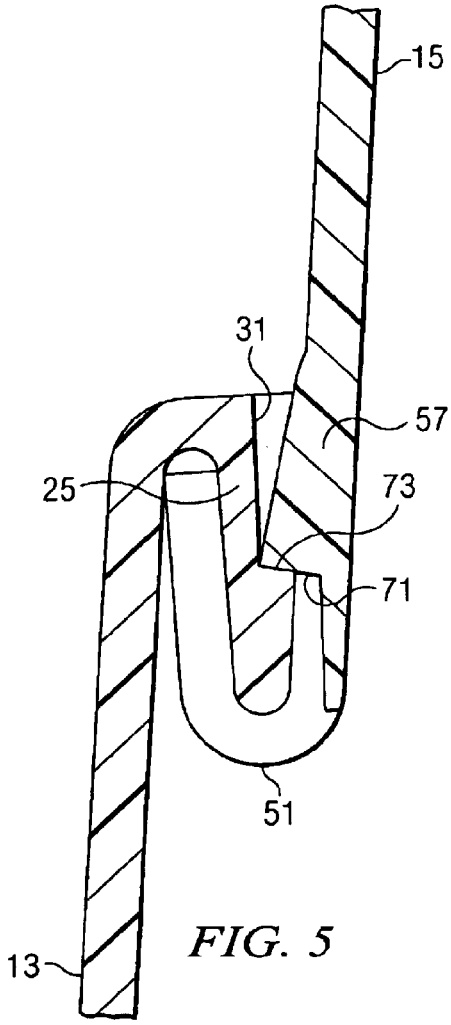
FIG. 5 illustrates a cross-sectional side view of the locking tab and the recess of FIG. 2 taken at V—V.

Referring to FIG. 5 in the drawings, tab 57 includes a downwardly facing shoulder 71, or first shoulder, and recess 31 includes an upwardly facing shoulder 73, or second shoulder. In the assembled position, tab 57 is received by recess 31, and the downwardly facing shoulder 71 lockingly engages the upwardly facing shoulder 73. The locking engagement between shoulders 71, 73 prevents movement of containment member 15 relative to base member 13 in the downward direction.

The base walls 21 of base member 13 are tapered outward as the walls rise from floor 23 to the open end of the base walls 21. Similarly, the upper containment walls 41 taper outward as the walls rise from engagement end 43 to the non-engagement end 45. The perimeter of the upper containment walls 41 at engagement end 43 is slightly larger than the perimeter of base walls 21 at the open end, but the downwardly facing lip is configured to engage the upwardly facing lip when the engagement end 43 of the containment member 15 and the open end of the base walls 21 are placed in close proximity (in the assembled position).

Referring to FIG. 3 in the drawings, the tapered aspect of base walls 21 and containment walls 41 allows the upper containment member 15 and the base member 13 to be placed in a nested position as shown. When the collapsible storage bin 11 is not assembled, base member 13 is configured to "nest" within upper containment member 15 such that the base walls 21 are located within the containment walls 41. Preferably, in the nested position, the open end of the base walls 21 is flush with the non-engagement end 45 of the upper containment walls 41. This arrangement allows the nested, or collapsed storage bin to be packaged or stored in a space no larger than the space required to store only the upper containment member 15.

In operation, the collapsible storage bin is packaged in the nested position for shipment from the manufacturer to the distributor or retailer. The nesting of the base member 13 within the upper containment member 15 allows the collapsible storage bin 11 to occupy less volume, which in turn decreases the amount of packaging material needed and decreases shipping costs. After arriving at the distributor or retailer, the collapsible storage bin occupies less space in inventory than a comparably-sized storage bin that does not break down. Finally, when an end consumer purchases the collapsible storage bin 11, the storage bin can be compactly stored when not in use by placing the base member 13 and the containment member 15 in the nested position.

When the consumer is ready to use storage bin 11, the storage bin 11 is easily converted from the nested position into the assembled position. Upper containment member 15 is pulled upward until the upwardly facing lip 51 begins to engage the downwardly facing lip 25 on the open end of the base walls 21. The consumer continues to pull the upper containment member until the upwardly facing lip 51 fully engages first receiving groove 61 and downwardly facing lip 25 fully engages second receiving groove 63. As previously mentioned, the base wall 21 tapers outward as it nears the open end, and this tapering causes contact between the tab 57 and the base wall 21 as the tab 57 approaches engagement with the recess 31. The contact between tab 57 and base wall 21 typically causes a local, elastic distortion of the base wall 21 and the containment wall 41 in the area around recess 31 and tab 57, respectively. This distortion has little effect on the position of the upper containment member 15 relative to the base member 13 since the upwardly facing lip 51 and the downwardly facing lip 25 are engaged. Additional upward force is applied to the upper containment member 15 in the area of each tab 57 until each tab 57 is received by one of the recesses 31. As the upwardly facing shoulder 73 and the downwardly facing shoulder 71 engage, the local distortion of the base wall 21 and the containment wall 41 disappears, and the base member 13 and the containment member 15 are locked in the assembled position.

Base member 13 and containment member 15 are preferably molded by injection molding, blow molding or vacuum molding processes. However, many different manufacturing processes could be used to produce the collapsible storage bin 11. The material used to construct base member 13 and containment member 15 is preferably polypropylene. Although many different materials could be used to construct base member 13 and containment member 15, it is preferred that the material be flexible to facilitate attachment of the base member 13 and containment member 15. The collapsible storage bin 11 has been described as having a generally rectangular shape, however, the shape could be round, triangular, polygonal, or any other shape that allows the base member and the upper containment member to lock as shown and described.

It is preferred that the base member 13 nest within the containment member 15 when the collapsible storage bin 11 is in the nested position, but the configuration of the base member 13 and the containment member 15 could be altered to allow the containment member 15 to nest within base member 13. In that configuration, the upper containment member 15 would include an upwardly facing lip that faced outward and engaged a downwardly facing lip on the base member 13 that faced inward. The perimeter of the upper containment member 15 at the engagement end of the containment walls would be slightly less than the perimeter of the base member 13 at the open end of the base walls. The containment member and base member would taper outward similar to those in FIGS. 1–3, but the smaller perimeter of the containment member would allow the containment member to nest within the base member.

Even though many of the examples discussed herein are applications of the collapsible storage bin comprised of a base member and a single upper containment member, a plurality of intermediate containment members could be used to expand the storage capacity of the collapsible storage bin. In the assembled position, the intermediate containment members would be connected between the base member and the upper containment members using lips, recesses, and tabs that are complimentary to those present on the base member and the upper containment member. Preferably, in a nested position, the base member and all of the intermediate containment members would nest within the containment walls of the upper containment member.

The intermediate containment member includes a plurality of intermediate containment walls which generally match the shape of base member 13 and upper containment member 15. An intermediate upper lip is disposed on an upper end of each intermediate containment wall and is similar to the downwardly facing lip 25 of the base member 13. An intermediate lower lip is disposed on a lower end of the intermediate containment wall, the intermediate lower lip being similar to the upwardly facing lip 51 of the upper containment member 15.

When one intermediate containment member is used, the intermediate upper lip is configured to engage the upwardly facing lip 51 of the upper containment member 15, and the intermediate lower lip is configured to engage the downwardly facing lip 25 of the base member. Intermediate tabs and intermediate recesses are provided on the intermediate containment member to lockingly engage the recesses 31 on the base member and the tabs 57 on the upper containment member.

From the foregoing description, it will be recognized that the collapsible storage bin of the present invention provides a superior system for providing storage for children's toys and other items. By providing an upwardly facing lip, a downwardly facing lip, recesses, and tabs, the storage bin can be assembled to provide a secure container for storing lightweight or heavy items. One advantage provided by the storage bin of the present invention is that the storage bin can be selectively assembled or disassembled. By disengaging the tabs from the recesses, the upper containment member and the base member can be separated. Another advantage provided by the storage bin is the ability of the base member to nest within the containment member when disassembled. This results in the storage bin occupying less volume in the disassembled position, thereby decreasing the costs of packaging and shipping the storage bin.

It should be apparent from the foregoing specification that an invention having significant advantages has been provided. While the invention is shown in only a few of its forms, it is not just limited but is susceptible to various changes and modifications without departing from the spirit thereof.

We claim:

1. A collapsible storage bin comprising:

a base member having a floor and a plurality of base walls extending upward from the floor, the base walls forming an opening at an open end of the base walls opposite the floor;

a downwardly facing lip disposed on the open end of at least one of the base walls, the downwardly facing lip forming a first receiving groove between the downwardly facing lip and the base wall; an upper containment member having a plurality of containment walls;

an upwardly facing lip disposed on an engagement end of at least one of the containment walls, the upwardly facing lip forming a second receiving groove between the upwardly facing lip and the containment wall;

a locking tab having a downwardly facing shoulder formed on an inner surface of at least one of the upper containment walls;

a recess having an upwardly facing shoulder formed on an outer surface of the downwardly facing lip;

wherein the downwardly facing lip and the upwardly facing lip are configured to engage such that the downwardly facing lip nests within the second receiving groove and the upwardly facing lip nests within the first receiving groove; and wherein the locking tab and the recess are configured to matingly engage such that the downwardly facing shoulder mates with the upwardly facing shoulder.

2. A collapsible storage bin according to claim 1, wherein the downwardly facing lip extends around the entire perimeter of the base walls.

3. A collapsible storage bin according to claim 1, wherein the upwardly facing lip extends around the perimeter of the containment walls except for in an area including the locking tab.

4. A collapsible storage bin according to claim 1, wherein the upwardly facing lip and the downwardly facing lip have hook-shaped cross sections.

5. A collapsible storage bin according to claim 1, wherein:

the downwardly facing lip protrudes outward from an exterior surface of the base wall; and the upwardly facing lip protrudes inward from an inner surface of the containment wall.

6. A collapsible storage bin according to claim 1, wherein the base walls of the base member nest within the containment walls of the containment member when the base member and the containment member are in a disassembled position.

7. A collapsible storage bin according to claim 1, wherein the smallest perimeter of the containment walls is greater than the largest perimeter of the base walls.

8. A collapsible storage bin according to claim 1, wherein:

each base wall includes a closed end opposite the open end;

the base walls are tapered outward to form a larger perimeter at the open end than at the closed end;

each containment wall includes a non-engagement end opposite the engagement end; and the containment walls are tapered outward to form a larger perimeter at the non-engagement end than at the engagement end.

9. A collapsible storage bin according to claim 1 further comprising:

an intermediate containment member having a plurality of intermediate containment walls;

an intermediate upper lip disposed on at least one of the intermediate containment walls at an upper end of the wall;

an intermediate lower lip disposed on at least one of the intermediate containment walls at a lower end of the wall;

wherein the intermediate upper lip is configured to engage the upwardly facing lip on the upper containment member; and wherein the intermediate lower lip is configured to engage the downwardly facing lip on the base member.

10. A collapsible storage bin according to claim 9 further comprising:

an intermediate tab formed on the intermediate containment member;

an intermediate recess formed on the intermediate containment member;

wherein the intermediate tab is configured to lockingly engage the recess on the base member; and wherein the intermediate recess is configured to lockingly engage the locking tab on the upper containment member.

* * * * *